US007273102B2

(12) United States Patent
Sheffield

(10) Patent No.: US 7,273,102 B2
(45) Date of Patent: Sep. 25, 2007

(54) REMOTELY ACTUATING A CASING CONVEYED TOOL

(75) Inventor: Randolph J. Sheffield, Sugar Land, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 222 days.

(21) Appl. No.: 10/709,800

(22) Filed: May 28, 2004

(65) Prior Publication Data

US 2005/0263286 A1 Dec. 1, 2005

(51) Int. Cl.
*E21B 43/119* (2006.01)
*E21B 47/12* (2006.01)

(52) U.S. Cl. ..... 166/297; 166/55; 175/40; 340/853.2

(58) Field of Classification Search ..... 166/297, 166/299, 55; 175/40; 340/853.2, 854.3
See application file for complete search history.

(56) References Cited

U.S. PATENT DOCUMENTS 4,648,471 A * 3/1987 Bordon ..... 175/4.55
5,445,228 A 8/1995 Rathmell et al.
5,829,538 A * 11/1998 Wesson et al. ..... 175/4.6
6,009,947 A 1/2000 Wilson et al.
6,386,288 B1 5/2002 Snider et al.
6,536,524 B1 * 3/2003 Snider ..... 166/297
6,557,636 B2 * 5/2003 Cernocky et al. ..... 166/297
6,584,406 B1 * 6/2003 Harmon et al. ..... 702/6
6,885,918 B2 * 4/2005 Harmon et al. ..... 701/14
6,962,202 B2 * 11/2005 Bell et al. ..... 166/297
2002/0088620 A1 * 7/2002 Lerche et al. ..... 166/297
2003/0000411 A1 * 1/2003 Cernocky et al. ..... 102/200
2003/0000703 A1 * 1/2003 Cernocky et al. ..... 166/297
2003/0001753 A1 * 1/2003 Cernocky et al. ..... 340/853.1
2003/0098157 A1 5/2003 Hales et al.
2004/0006430 A1 1/2004 Harmon et al.

FOREIGN PATENT DOCUMENTS

GB 2352261 A 1/2001
WO WO03/002849 A1 1/2003

* cited by examiner

*Primary Examiner*—David Bagnell
*Assistant Examiner*—Shane Bomar
(74) *Attorney, Agent, or Firm*—Trop, Pruner + Hu, P.C.; Kevin B. McGoff; Bryan P. Galloway

(57) ABSTRACT

A technique that is usable with a subterranean well includes communicating a wireless stimulus downhole in the well and actuating a casing conveyed tool in response to the communication.

20 Claims, 15 Drawing Sheets

REMOTELY ACTUATING A CASING CONVEYED TOOL

BACKGROUND OF INVENTION

The invention generally relates to remotely actuating a casing conveyed tool.

A typical subterranean well includes a casing string that lines a wellbore of the well. One or more downhole tools may be integrated with the casing string, an arrangement that permits these tools to be installed with the string. These tools, called "casing conveyed tools," may include such tools as perforating guns and formation isolation valves.

A casing conveyed perforating gun typically requires an electric line to the surface. The presence and installation of such a line complicates the deployment of any perforating guns and the cementing operation. Such an electric line also adds hardware cost and time to the process.

Thus, there is a continuing need for a system and/or technique to address one or more of the problems that are stated above. There is also a continuing need for a system and/or technique to address problems that are not set forth above.

SUMMARY OF INVENTION

In an embodiment of the invention, a technique that is usable with a subterranean well includes communicating a wireless stimulus downhole in the well and actuating a casing conveyed tool in response to the communication.

Advantages and other features of the invention will become apparent from the following description, drawing and claims.

DETAILED DESCRIPTION

Figure 1:
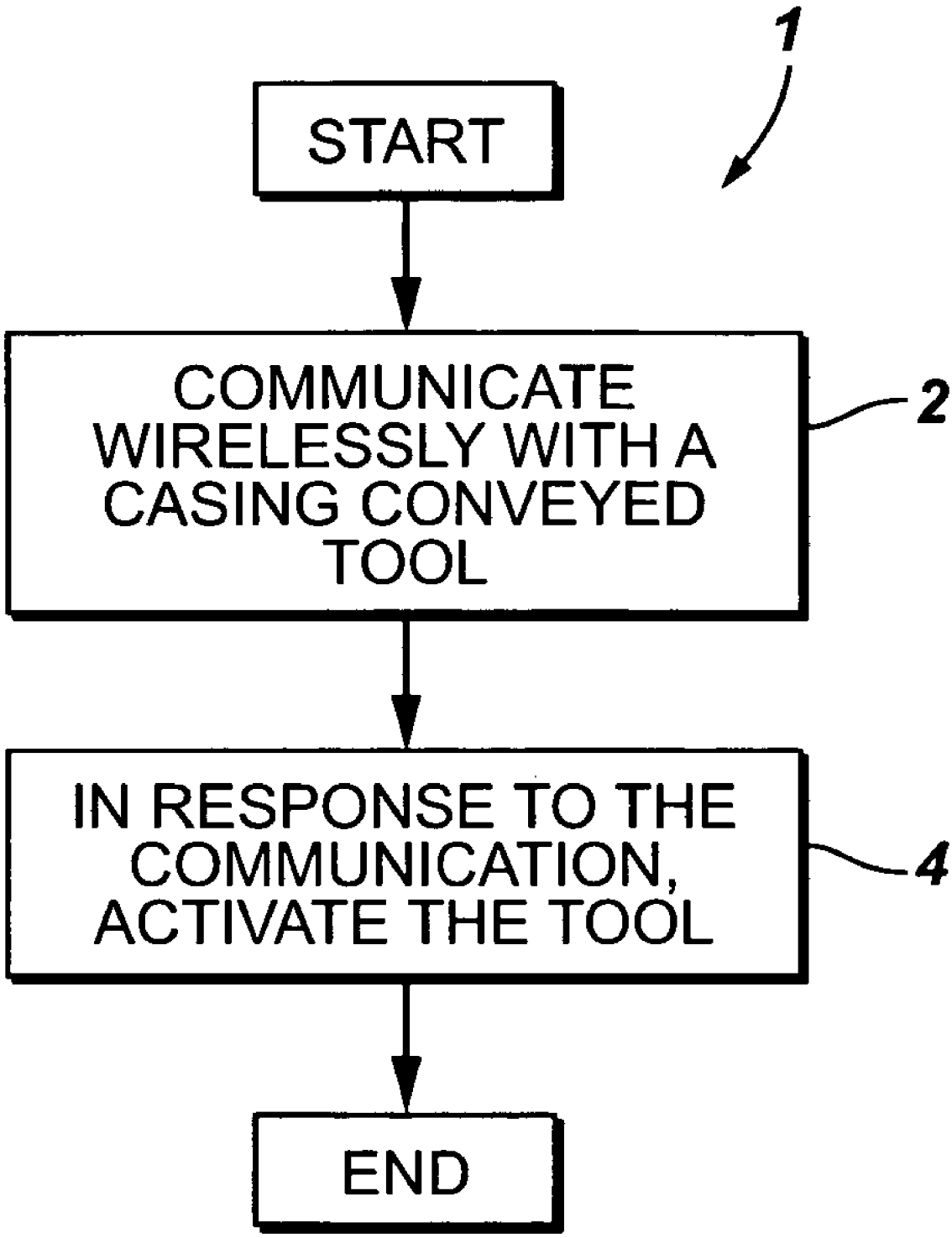
FIG. 1 is a flow diagram depicting a technique to operate a casing conveyed tool according to an embodiment of the invention.

Referring to FIG. 1, an embodiment 1 of a technique in accordance with the invention may be used for purposes of actuating a casing conveyed tool. In the context of this application, a "casing conveyed tool" is a tool that is integrated into the well casing itself. Thus, the casing conveyed tool is installed with one or more casing string sections, as the tool is integrated with the section(s). As examples, the casing conveyed tool may be a casing conveyed perforating gun, a casing conveyed valve (such as a formation isolation valve), expandable screen, etc.

The technique 1 includes communicating wirelessly with the casing conveyed tool, as depicted in block 2 of FIG. 1. As described further below, this wireless communication includes the transmission of a wireless stimulus downhole for purposes of instructing the tool to perform some downhole function. As examples, the wireless stimulus may be an electromagnetic wave that propagates through a casing string or tubing or through the earth (and through one or more formations) to the casing conveyed tool; an acoustic wave that propagates downhole along a tubular string, such as a production tubing or the casing string; or a pressure pulse that propagates downhole through some fluid, such as the fluid in the production tubing or casing or fluid in the well's annulus. Furthermore, the wireless stimulus may be one out of multiple wireless stimuli that are communicated downhole to perform a particular downhole function. Regardless of the form of the wireless stimulus, in response to this communication, the technique 1 includes actuating the tool, as depicted in block 4.

A potential advantage of the above-described technique is that, as compared to the actuation of conventional casing conveyed tools, a downhole run is not required for the specific purpose of actuating the tool. Thus, not only is time saved in actuating the tool, the potential cost and complexity associated with the use of the tool are reduced. Other and different advantages may be possible in other embodiments of the invention.

Figure 2:
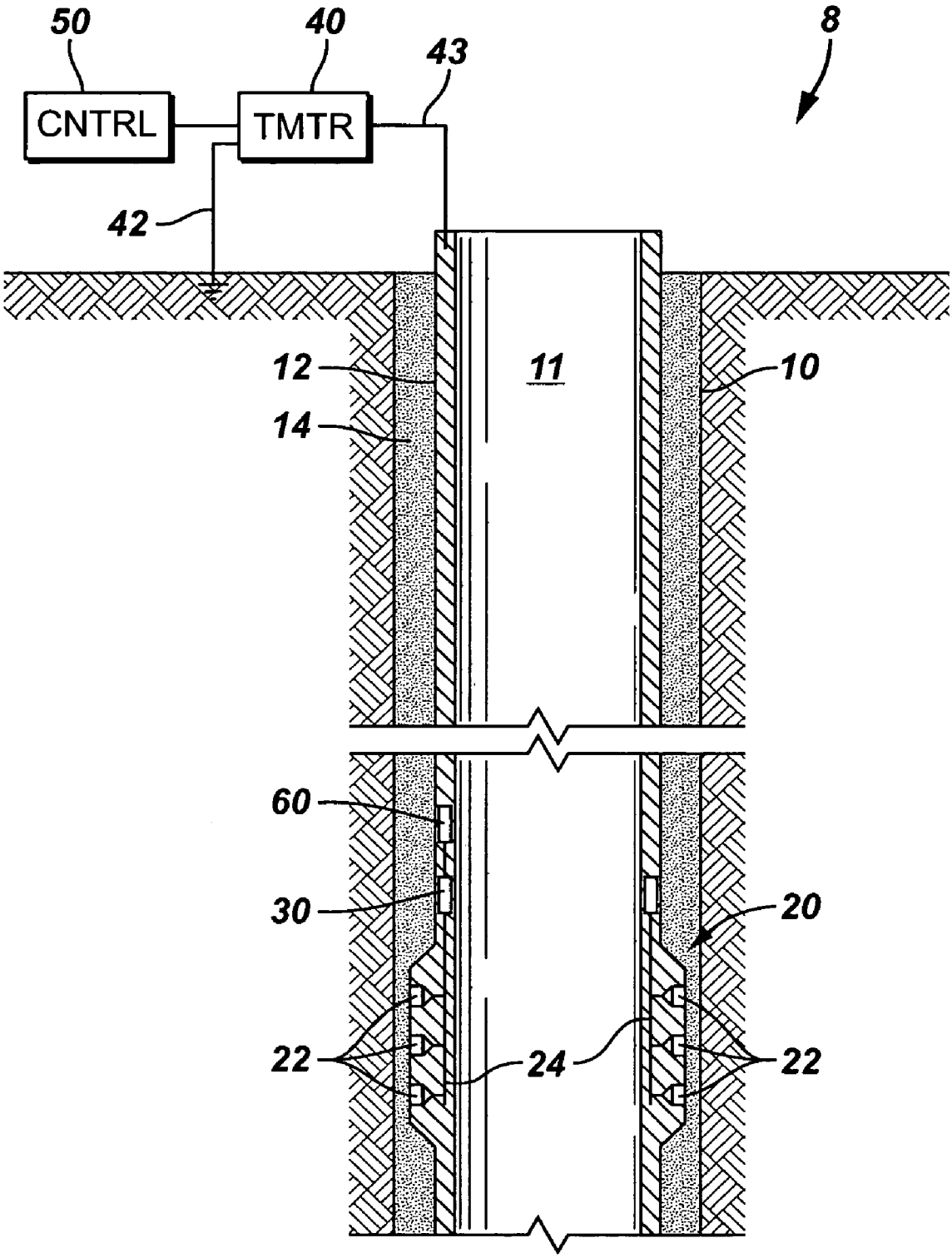
FIGS. 2, 5 and 8 are schematic diagrams of a subterranean well in accordance with different embodiments of the invention.

As a more specific example, in some embodiments of the invention, the casing conveyed tool may be a casing conveyed perforating gun 20 of a well 8 that is depicted in FIG. 2. As its name implies, the casing conveyed perforating gun 20 is part of a casing string 12 that lines a wellbore 10. Although depicted as lining a vertical wellbore of the well 8, the perforating gun 20 may be located in a lateral wellbore, depending on the particular embodiment of the invention. Similarly, there may be more than one perforating gun 20 deployed on the casing structure. As depicted in FIG. 2, the casing string 12 is cemented in place inside the wellbore 10. Such cementing may occur before operation of the perforating tool 20. In other embodiments of the invention, the casing string 12 may not be cemented in place inside the wellbore.

For purposes of communicating with the perforating gun 20, the well 8 includes an apparatus that is located at the surface of the well 8 for purposes of transmitting one or more wireless stimuli downhole. For example, as depicted in FIG. 2, in some embodiments of the invention, this apparatus may include a transmitter 40 that generates an electromagnetic signal that appears between an output terminal 43 (that is coupled to the casing string 12) of the transmitter 40 and a ground terminal 42 (that is coupled to the earth) of the transmitter 40. The transmitted electromagnetic signal propagates from the transmitter 40 downhole through one or more formation(s) to the perforating gun 20. The transmitter 40 may be coupled to a controller 50 (that may also be located at the surface of the well 8, for example) that controls the generation and signature of the electromagnetic wave, as well as selectively activates the transmitter 40 when transmission of the electromagnetic wave is desired. For example, in some embodiments of the invention, the controller 50 may activate the transmitter 40 for purposes of transmitting an electromagnetic wave to communicate a fire command downhole to fire shaped charges 22 of the perforating gun 20.

In some embodiments of the invention, for purposes of receiving the stimulus that is generated by the apparatus at the surface, the casing string 12 includes receiver circuitry 60 that may be integrated (as an example) with the casing string 12. Thus, in some embodiments of the invention, the receiver circuitry 60 may be installed with the casing string 12 and thus, with the perforating gun 20. In other embodiments of the invention, the receiver circuitry 60 may be separate from the casing string 12.

For embodiments of the invention in which the transmitter 40 communicates an electromagnetic wave downhole, the receiver circuitry 60 may include a sensor and electronics to detect the electromagnetic wave and respond by activating a firing system 30 that is located downhole near the receiver circuitry 60 and perforating gun 20. Similar to the receiver circuitry 60, the firing system 30 may be integrated with the casing string 12, in some embodiments of the invention.

When activated, the firing system 30 produces a detonation wave on one or more detonating cords 24 that extend to the shaped charges 22. The presence of the detonation waves on the detonating cords, in turn, cause the shaped charges 22 to fire and produce perforation jets that perforate the surrounding casing string 12 and formation(s).

Although not depicted in FIG. 2, in some embodiments of the invention, the perforating gun 20 may have multiple sets of shaped charges 22 so that the firing system 30 may selectively fire different sets of shaped charges 22 in response to the communication from the receiver circuitry 60. Thus, in some embodiments of the invention, the transmitter 40 may communicate different commands downhole to the receiver circuitry 60 for purposes of selectively firing the different sets of shaped charges 22.

Therefore, in some embodiments of the invention, the electromagnetic wave that is communicated downhole may be encoded with a particular command. This command may indicate a particular action to be performed (such as firing a perforating gun or opening a formation isolation valve, for example). The electromagnetic wave may also be encoded with an address that identifies the particular tool or subset of the tool that should respond to the command. Many other variations are possible in other embodiments of the invention.

Figure 3:
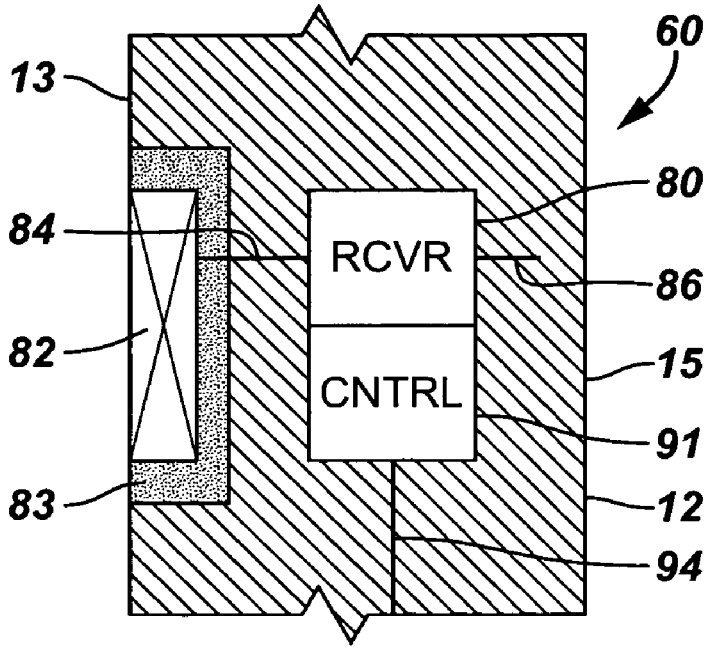
FIGS. 3 and 4 are schematic diagrams depicting downhole receiver circuitry according to different embodiments of the invention.

Referring also to FIG. 3, in embodiments of the invention in which the casing conveyed tool is a perforating gun and electromagnetic waves are used to communicate with the perforating gun, the receiver circuitry 60 may have a form that is depicted in FIG. 3. In this embodiment of the invention, the receiver circuitry 60 includes a receiver 80 that communicates (via a communication line 84) with an electromagnetic transducer 82. An outer face of the transducer 82 is exposed on an exterior surface 13 of the casing string 12 so that the transducer 82 is electrically coupled to the surrounding formation. Furthermore, the transducer 82 is embedded in a dielectric material 83 for purposes of electrically isolating the transducer 82 from the conductive well casing string 12. The receiver 80 also has a terminal 86 that is coupled to the well casing 12. Thus, via its connections to the well casing 12 and to the transducer 82, the receiver circuitry 80 detects any electromagnetic wave that is communicated by the transmitter 40.

In some embodiments of the invention, in addition to the transducer 82, the receiver circuitry 60 includes a controller 91 for purposes of extracting any command/address information from the wave. The controller 91, in response to recognizing a particular command for the firing system 30, communicates (via one or more communication lines 94) with the firing system 30 for purposes of firing a selected set of shaped charges 22.

The inclusion of the transducer 82 near the exterior surface 13 of the casing string 12 provides one or more advantages. For example, such an arrangement benefits wireless telemetry systems that transmit signals through the earth in that, if the wellbore is cased, the signal sent through the casing to a location interior of the casing may lose a substantial amount of strength as it passes through the casing. Thus, this arrangement benefits the communication of wireless signals, such as electromagnetic signals and seismic signals that are communicated through the earth since there is no corresponding signal loss through the casing.

Figure 4:
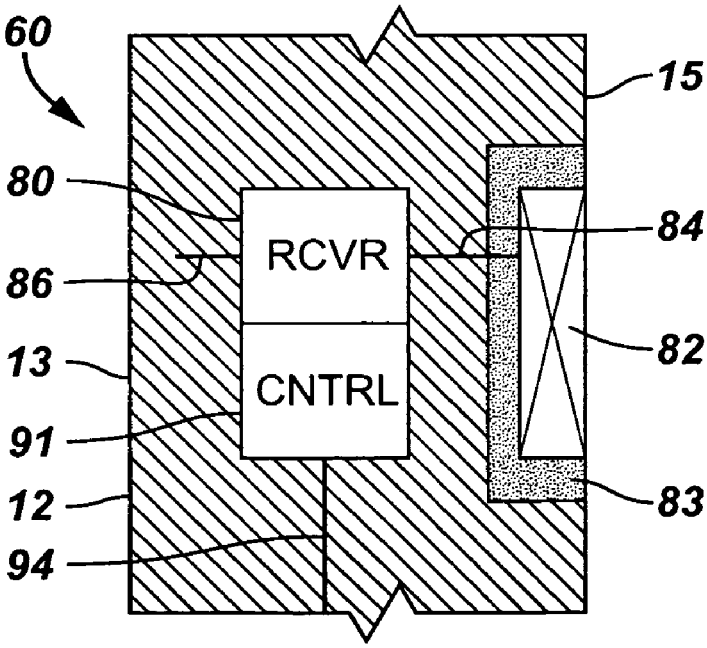

Referring to FIG. 4, it is noted that in other embodiments of the invention, the transducer 82 may be located on an interior surface 15 of the casing string 12. In this embodiment of the invention, the transducer 82 is positioned to detect electromagnetic signals that extend inside the casing string 12. A particular advantage of this arrangement is that the transducer 82 may be better protected during the installation of the casing string 12.

Although FIG. 2 depicts the communication of an electromagnetic wave, it is understood that in other embodiments of the invention, other wireless stimuli may be communicated downhole. For example, in some embodiments of invention, the transmitter 40 may be replaced by a mud pump for purposes of modulating a fluid pressure to communicate fluid pressure pulses (another form of wireless stimuli) downhole. This fluid pressure may be, for example, fluid in a production tubing, fluid in a well annulus or, etc. As another example, in other embodiments of the invention, the transmitter 40 may be replaced by a seismic stimulus generator that produces a force at the well's surface for purposes of communicating a seismic signal downhole. As yet another example, in some embodiments of the invention, the transmitter 40 may be replaced by an acoustic generator that communicates an acoustic signal downhole. For example, this acoustic signal may propagate along the well casing 12, a production tubing, etc. Thus, the appended claims cover embodiments in which a wireless stimulus other than an electromagnetic wave is communicated downhole to actuate a casing conveyed tool.

In some embodiments of the invention, the firing system 30 may be a mechanical system, electrical system, a hydraulic system, an optical system or a hybrid combination of two or more such systems. For example, in some embodiments of the invention, the firing system 30 may include a valve to selectively open a port to allow hydrostatic fluid to act on a pressure-actuated firing head or open a port that enables surface supply pressure to act on the pressure actuated firing head. As another example, in some embodiments of the invention, the firing system 30 may include an optical system, such as a system that allows optical energy to act on a light-sensitive firing head. For the case where the firing system 30 is an electronic system, the firing system 30 may include a firing head that is actuated by a potential difference above a predetermined magnitude. Many other variations are possible and are within the scope of the appended claims, in other embodiments of the invention.

Figure 5:
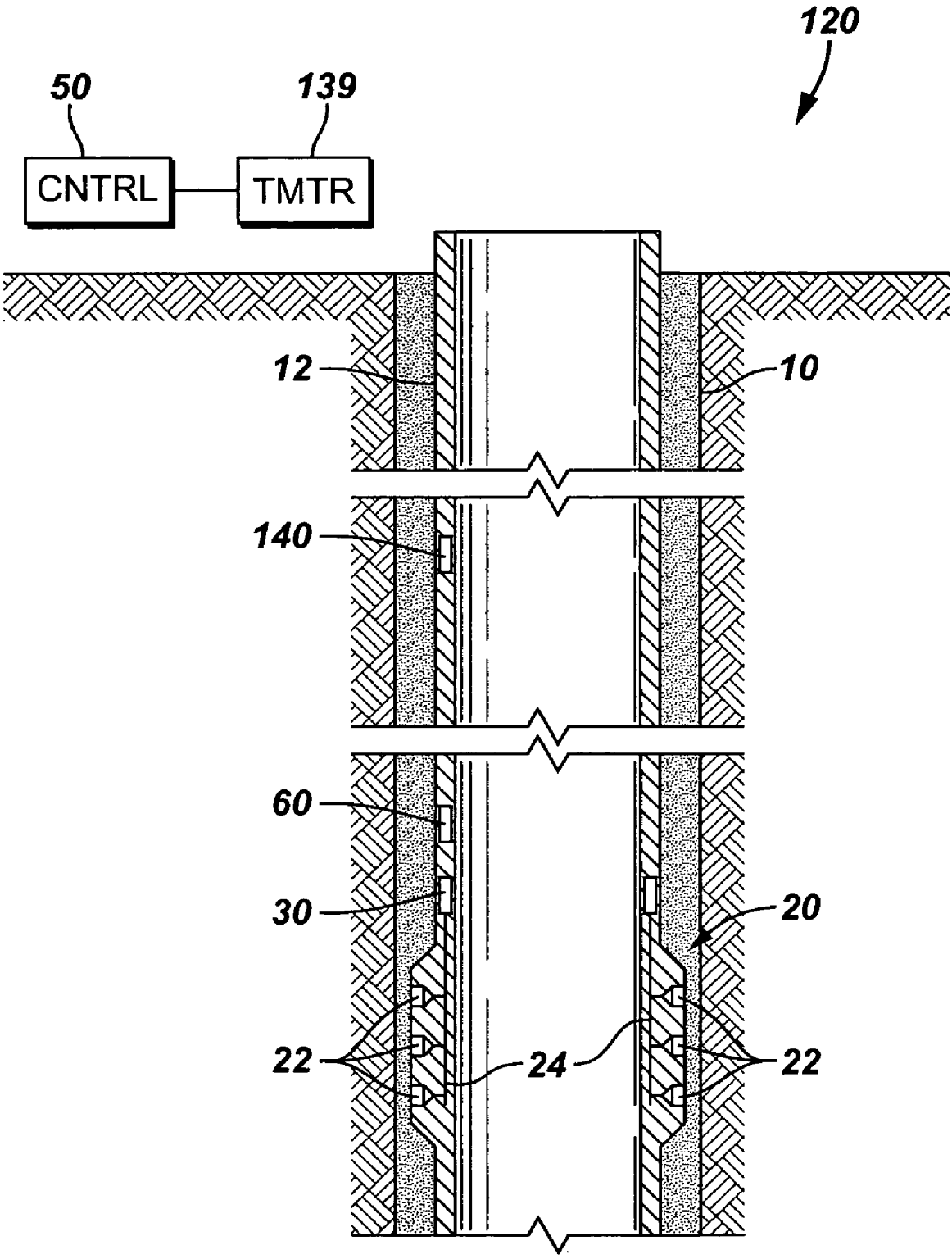

Referring to FIG. 5, in some embodiments of the invention, the transmitter that generates the wireless stimulus that is received by the receiver circuitry may itself be located downhole. Thus, a system 120 may include a transmitter 140 that is located at some depth in the well for purposes of wirelessly communicating a stimulus to the receiver circuitry 60. A wired or wireless link may exist between the transmitter 140 and a surface transmitter 139 that communicates with the transmitter 140. The surface transmitter 139 is coupled to the controller 50. As a more specific example, in some embodiments of the invention, the transmitter 140 may include a transducer that is embedded in a dielectric medium in either the inner or outer surface of the casing string 12 for purposes of communicating an electromagnetic signal to the receiver circuitry 60. Alternatively, the transmitter 140 may include one or more acoustic transducers for purposes of generating an acoustic signal on the well casing 12. Many other arrangements are possible. For example, in some embodiments of the invention, the downhole transmitter may operate a particular downhole valve for purposes of modulating a fluid pressure that propagates to the receiver circuitry 60. Thus, other arrangements are within the scope of the appended claims.

Figure 6:
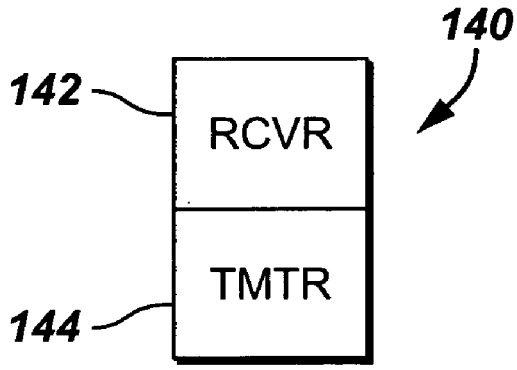
FIG. 6 is a block diagram of downhole transmitter circuitry according to an embodiment of the invention.

In some embodiments of the invention, the transmitter 140 may have a general form that is depicted in FIG. 6. As shown, the transmitter 140 includes a receiver section 142 for purposes of communicating with the surface transmitter 139 and a transmitter portion 144 for purposes of communicating the wireless stimulus to the receiver circuitry 60. Thus, in some embodiments of the invention, the transmitter 140 may effectively form a repeater to transmit a wireless stimulus in response to another stimulus (wired or wireless) that propagates from the surface of the well.

Figure 7:
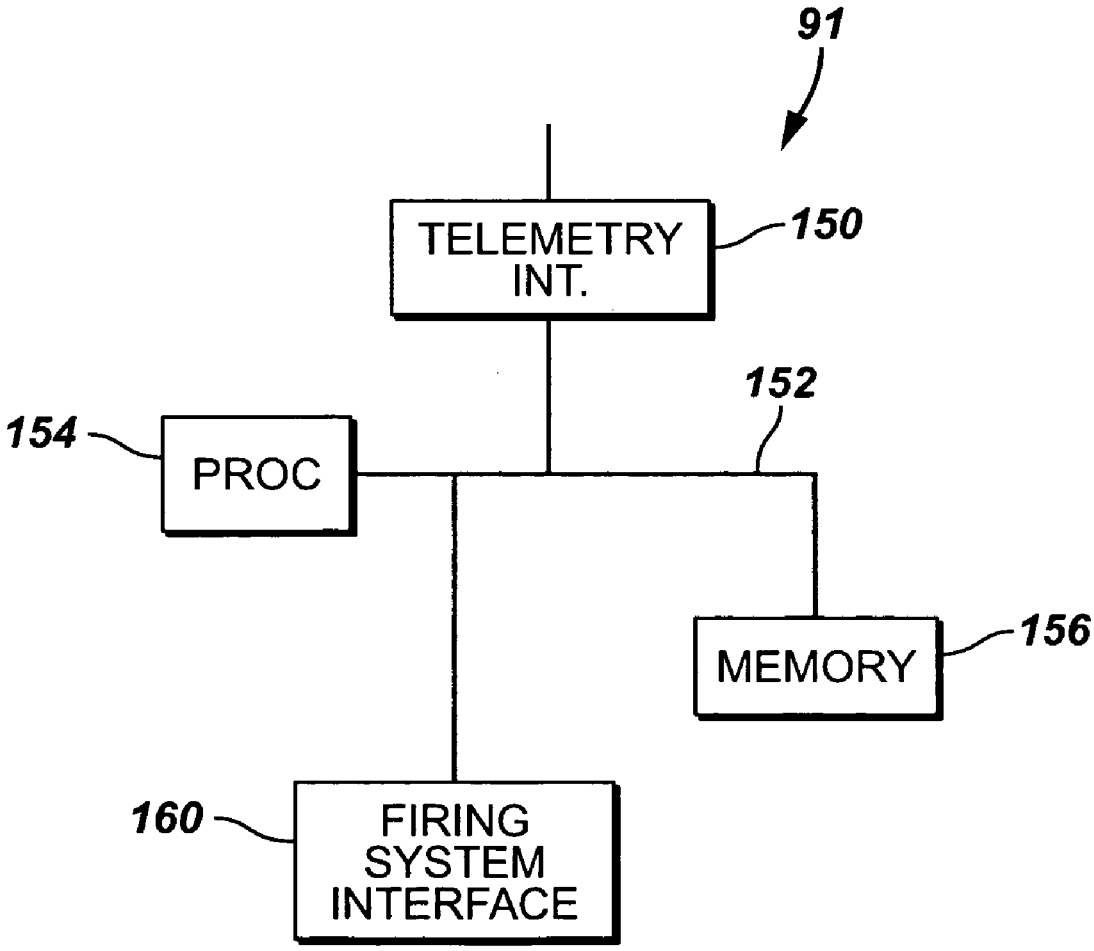
FIG. 7 is a block diagram of control circuitry of the receiver circuitry according to an embodiment of the invention.

In some embodiments of the invention, the controller 91 (see FIGS. 3 and 4, for example) of the receiver circuitry 60 may include circuitry similar to the circuitry that is depicted in FIG. 7. This circuitry includes a telemetry interface 150 for purposes of receiving signals from a transducer, bandpass filtering the signals and converting these signals into a digital form. The resulting digital signal may then be stored in a memory 156. The control circuitry 91 may include a processor 154 that processes the digital signal stored in the memory 156 for purposes of extracting any commands addresses and/or recognizing a signature of the digital signal. For the embodiments where the casing conveying tool is a perforating gun, the processor 154 may, upon recognizing a fire command for one or more sets of shaped charges of the perforating gun, activate the firing system 30 using a firing system interface 160.

Figure 8:
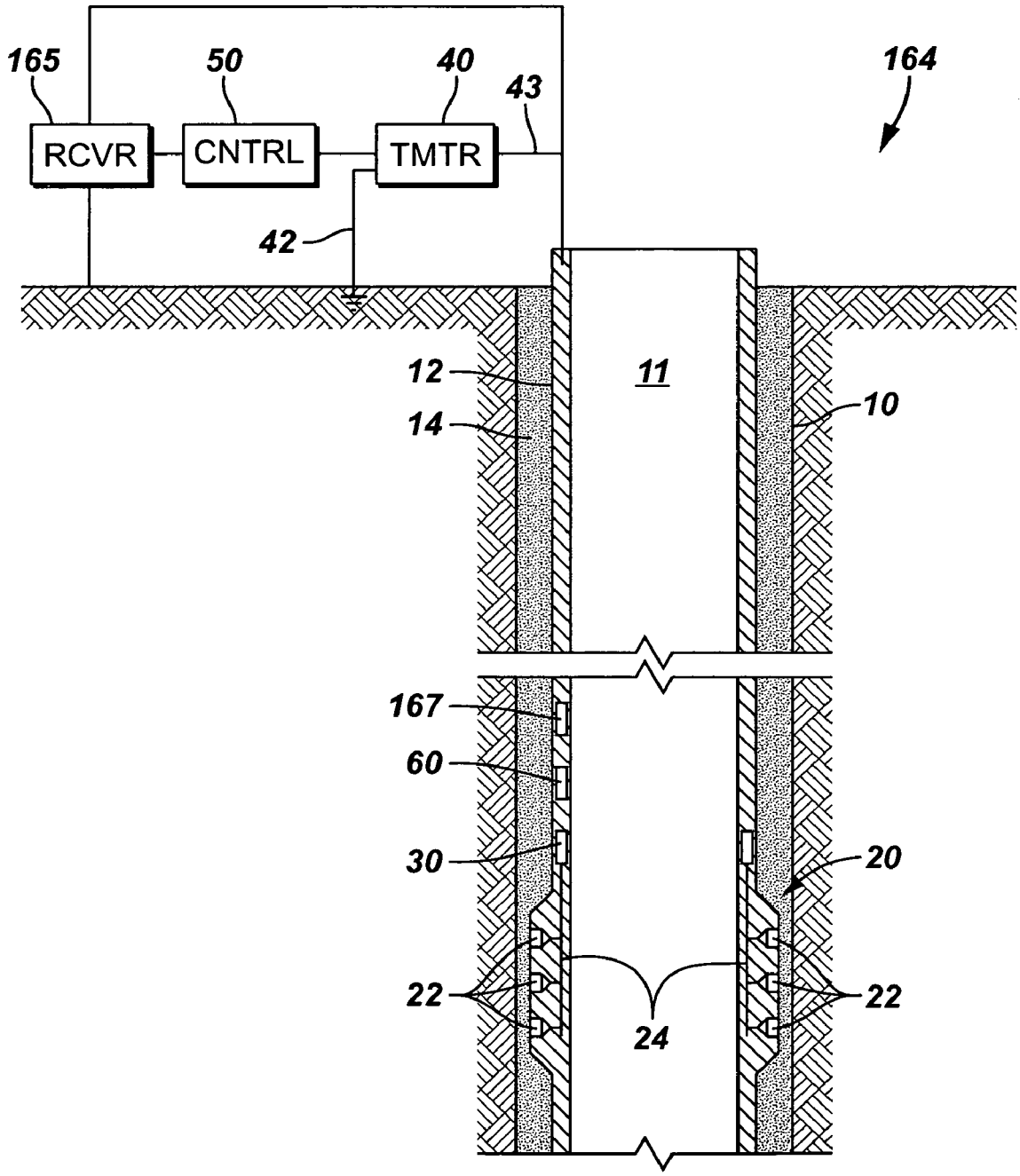
Figure 9:
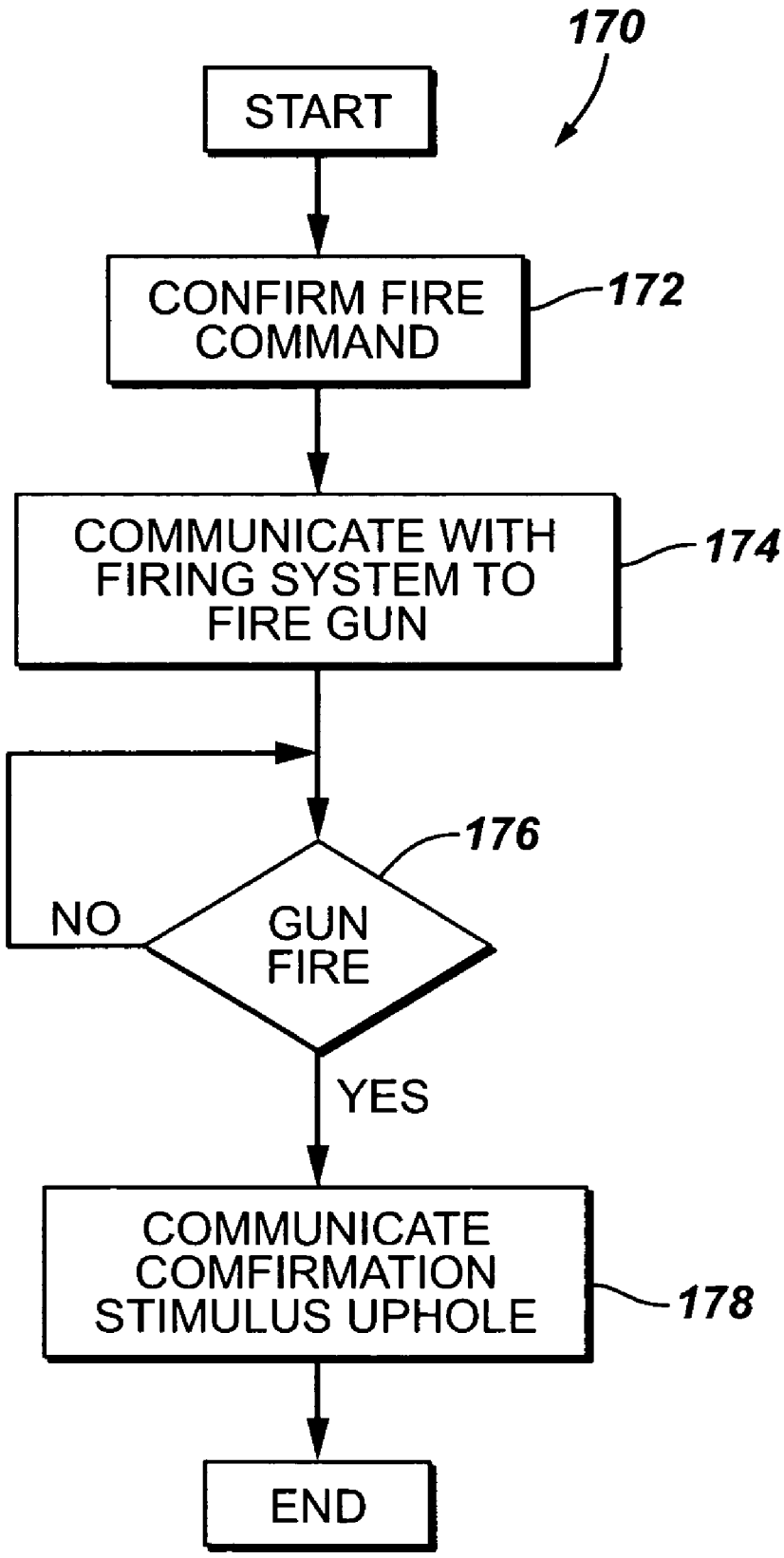
FIG. 9 is a flow diagram depicting a technique to actuate a casing conveyed perforation gun according to an embodiment of the invention.

Referring to FIG. 8, in some embodiments of the invention, the systems described above may be replaced by a system 164. The system 164 may, for example, have a similar design to the system that is depicted in FIG. 2, except that the system 164 includes a downhole transmitter 167. As an example, this transmitter 167 may be integrated with and thus installed with the casing string 12. The transmitter 167 is located near the receiver circuitry 60. As an example, the transmitter 167 may be wirelessly or wiredly connected to the receiver 60. The purpose of the transmitter 167 is to communicate a stimulus (a wireless or wired stimulus, depending on the particular embodiment of the invention) uphole for purposes of acknowledging that the casing conveyed tool has performed a particular operation. For embodiments of the invention in which the casing conveyed tool is a perforating gun, the transmitter 167 may be operated by the receiver circuitry 60 (such as by the processor of the receiver circuitry 60) to communicate a stimulus uphole to indicate firing of the perforating gun.

As a more specific example, in some embodiments of the invention, the transmitter 167 may be an electromagnetic wave transmitter to communicate an electromagnetic wave to the surface to be detected by a receiver circuit 165 at the surface of the well. As another example, the transmitter 167 may be an acoustic transmitter or may control a particular valve in the well for purposes of propagating a fluid pressure pulse(s) uphole to indicate the firing of the perforating gun. These pulse(s) are detected at the surface by pressure pulse sensor(s) and electronics (not shown). Thus, many other possible embodiments are within the scope of the appended claims.

Thus, in accordance with an embodiment of the invention, the receiver circuitry 60 may perform a technique similar to a technique 170. Pursuant to the technique 170, the receiver circuitry 60 confirms a fire command that is communicated from the surface, as depicted in block 172. After this confirmation, the receiver circuitry 60 communicates (block 174) with the firing system 30 to fire the perforating gun 20. The receiver circuitry 60 then waits to confirm firing of the perforating gun 20, as depicted in block 176. After detecting firing of the perforating gun 20, the receiver circuitry 60 then interacts with the transmitter 167 to communicate a confirmation stimulus uphole, as depicted in block 178.

Several different techniques may be used to detect the firing of the perforating gun 20 depending on the particular embodiment of the invention. For example, in some embodiments of the invention, the receiver circuitry 60 may include an acoustic transducer that monitors acoustic energy downhole for purposes of recognizing a frequency or time signature that uniquely identifies firing of the perforating gun 20. Alternatively, in some embodiments of the invention, the receiver circuitry 60 may attempt to communicate with the portion of the firing system 30 associated with the firing of a particular set of shaped charges 22. More specifically, during the firing of a particular set of perforating charges 22, a part of the firing system 30 may be destroyed. Therefore, if attempts to communicate with this portion of the firing system 30 are unsuccessful, in some embodiments of the invention, the receiver circuitry 60 concludes that this associated section of the perforating gun 20 has fired. Many other arrangements are possible in other embodiments of the invention.

Figure 10:
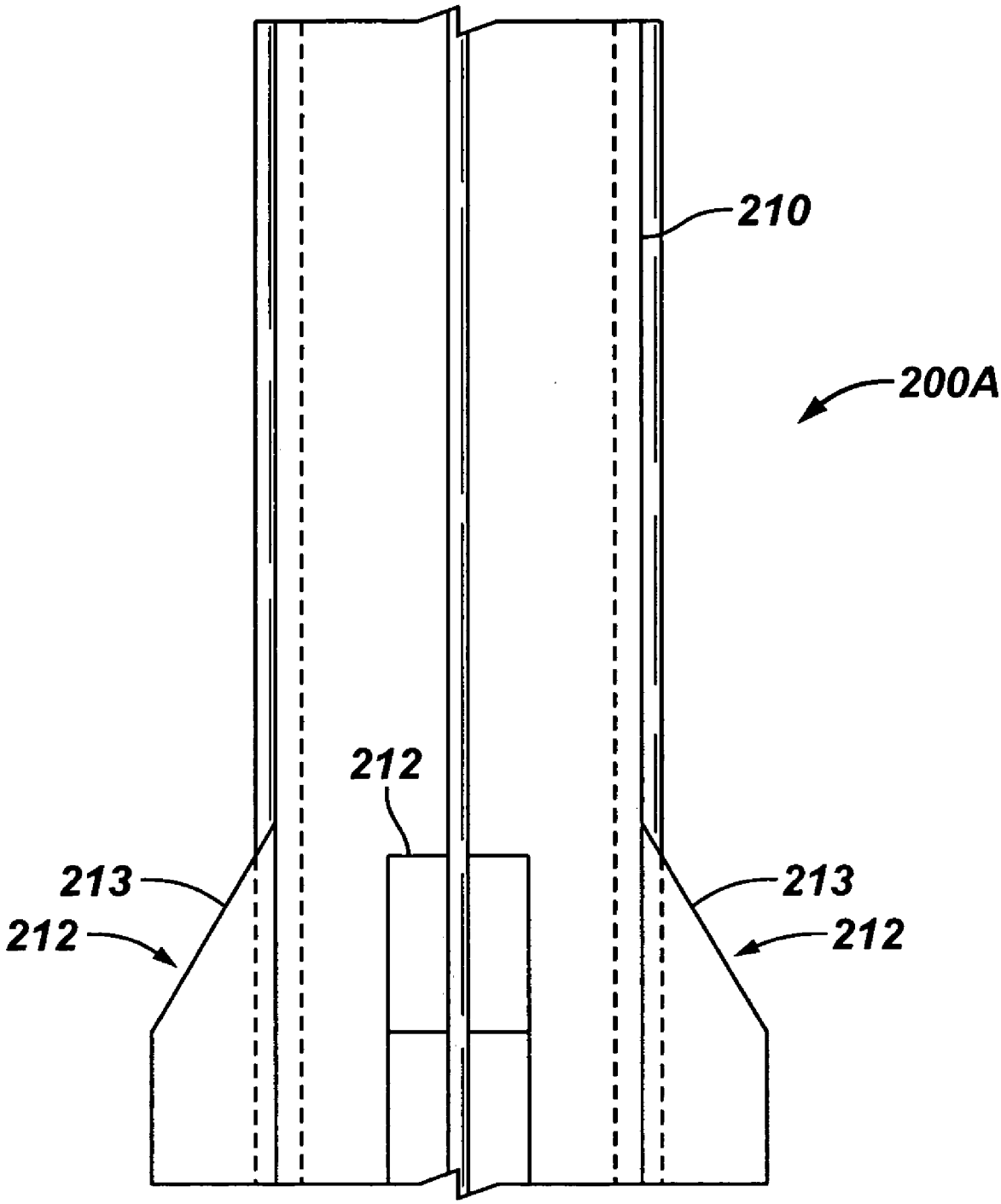
FIGS. 10, 11 and 12 depict a casing conveyed tool according to an embodiment of the invention.
Figure 11:
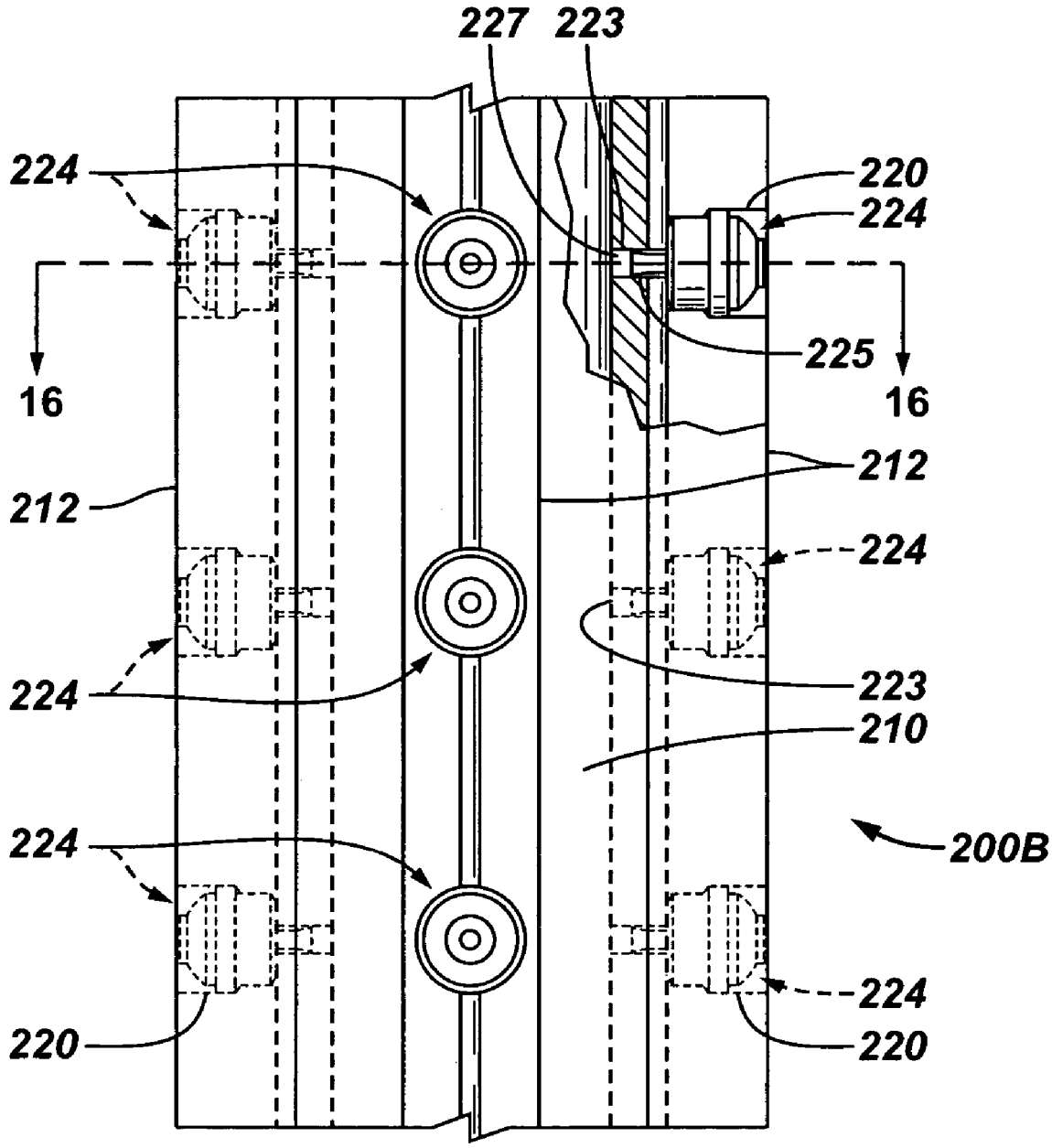
Figure 12:
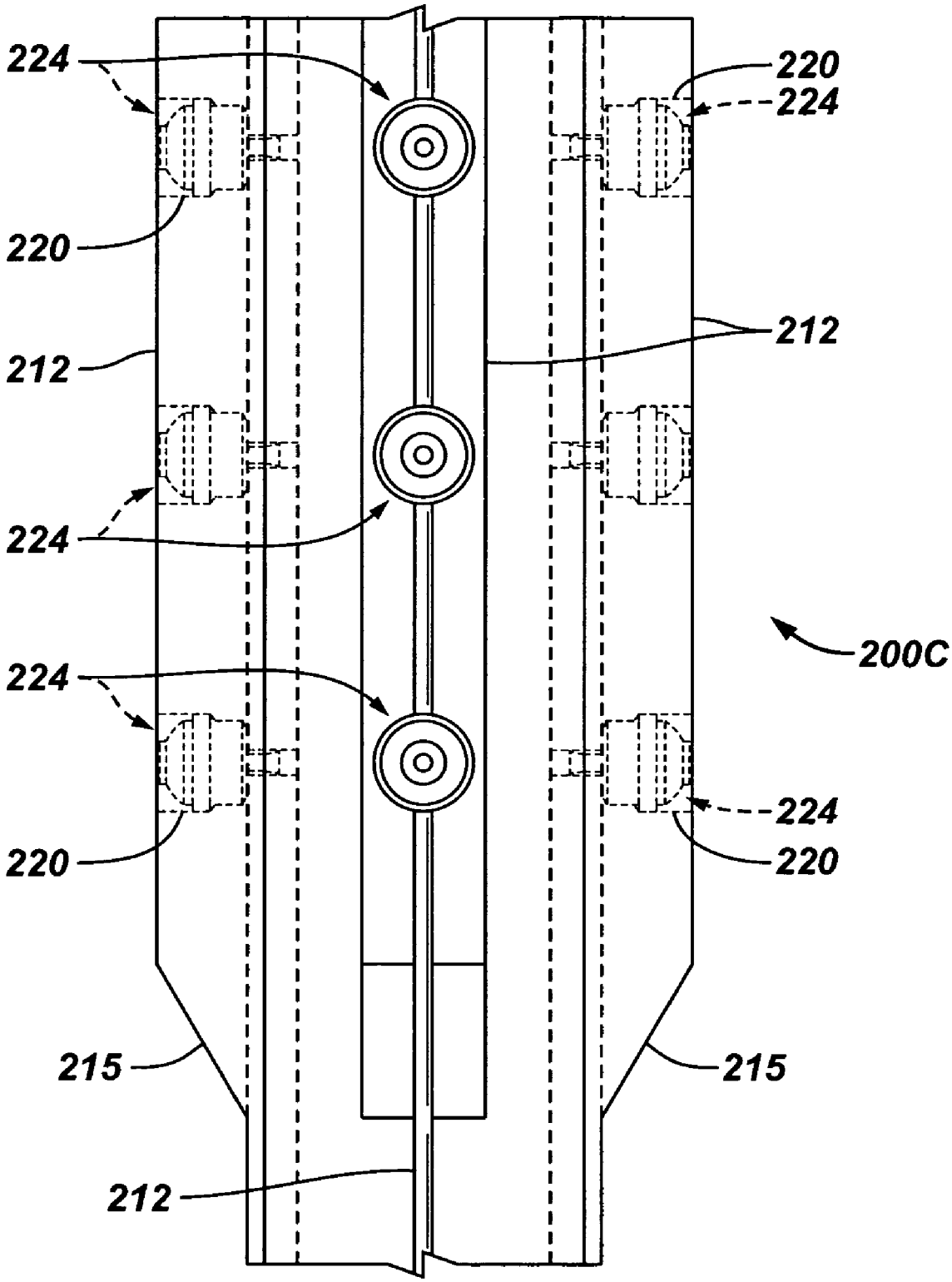

As a more specific example of a casing conveyed perforating tool, in accordance with some embodiments of the invention, FIGS. 10, 11 and 12 depict upper 200A, middle 200B and lower 200C sections, respectively, of a casing conveyed perforating tool 200. The perforating tool 200 represents one out of many possible casing conveyed tools in accordance with the invention. In some embodiments of the invention, the tool 200 includes a main casing body 210 that is generally a cylindrically shaped body with a central passageway therethrough. In some embodiments of the invention, the main casing body 210 may include threads (not shown) at its upper end for purposes of connecting the tool 200 to an adjacent upper casing section or another casing conveyed perforating tool. The main casing body 210 may include threads (not shown) at its lower end for purposes of connecting the tool 200 to an adjacent lower casing section or another casing conveyed perforating tool. Thus, the tool 200 may function as a casing string section, as the tool 200 may be connected in line with a casing string, in some embodiments of the invention.

The tool 200 includes fins 212 that extend along the longitudinal axis of the tool and radially extend away from the main casing body 210. In addition to receiving perforating charges (shaped charges, for example), as described below, the fins 212 form stabilizers for the tool 200 and for the casing string. Each fin 212 may include an upper beveled face 213 (FIG. 10) and a lower beveled face 215 for purposes of guiding the tool 200 through the wellbore. A perspective view of the main casing body 210 and fins 212 is shown in FIG. 15.

As depicted in FIG. 11, each fin 212 includes several openings 220 (see also FIG. 13), each of which extends radially away from the longitudinal axis of the tool 200 and receives a particular perforating charge 224. Each perforating charge 224, in turn, is oriented so that the perforating charge 224 generates a perforating jet in a radial direction into the surrounding formation. In the embodiment depicted in FIGS. 10-12, the perforating charges are arranged so that four perforating charges are contained in a plane (i.e., the perforating charges of each plane are oriented 90° apart). However, in other embodiments of the invention, the perforating charges 224 may be spirally arranged around the circumference of the casing body 210 to achieve a spiral phasing for the tool 200. In these embodiments of the invention, the openings 220 may be spaced to achieve the spiral phasing. In some embodiments of the invention, the fins 212 may helically extend around the main casing body 210 to achieve the spiral phasing. Many other variations for gun phasing, fin orientation and shaped charge orientation are possible and are within the scope of the appended claims.

Each perforating charge 224 is directed in a radially outward direction from the longitudinal axis of the tool 200 so that when the perforating charge 224 fires, the charge 224 forms a perforation jet that is radially directed into the surrounding formation. Initially, before any perforating charges 224 fire, the tool 200 functions as a typical casing section in that there is no communication of well fluid through the casing wall and the central passageway. As described below, the firing of the perforating charges 224 produce communication paths between the tunnels formed by the charges 224 and the central passageway of the tool 200.

Figure 15:
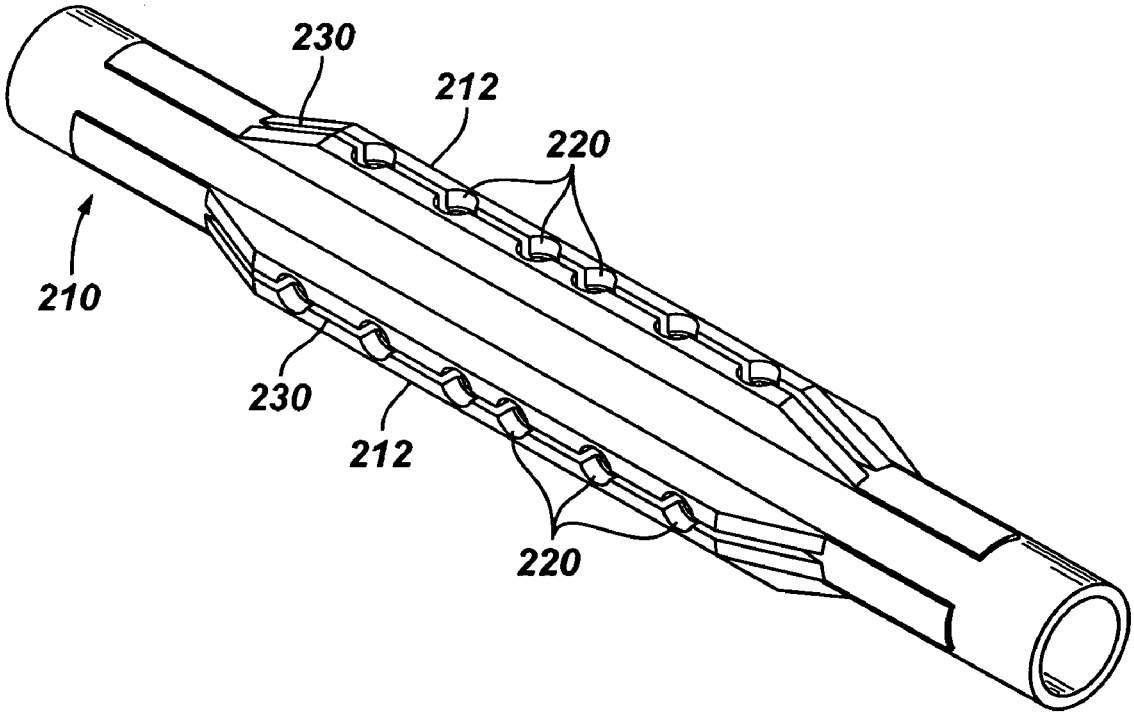
FIG. 15 depicts a main body of the casing according to an embodiment of the invention.

Referring to FIG. 15, each fin 212 includes a groove 230 that extends along the longitudinal axis of the casing and intersects each one of the openings 220 of the fin 212. This groove 230 may be used for purposes of routing a detonating cord (not shown in FIG. 15) to each of the perforating charges 220.

Figure 16:
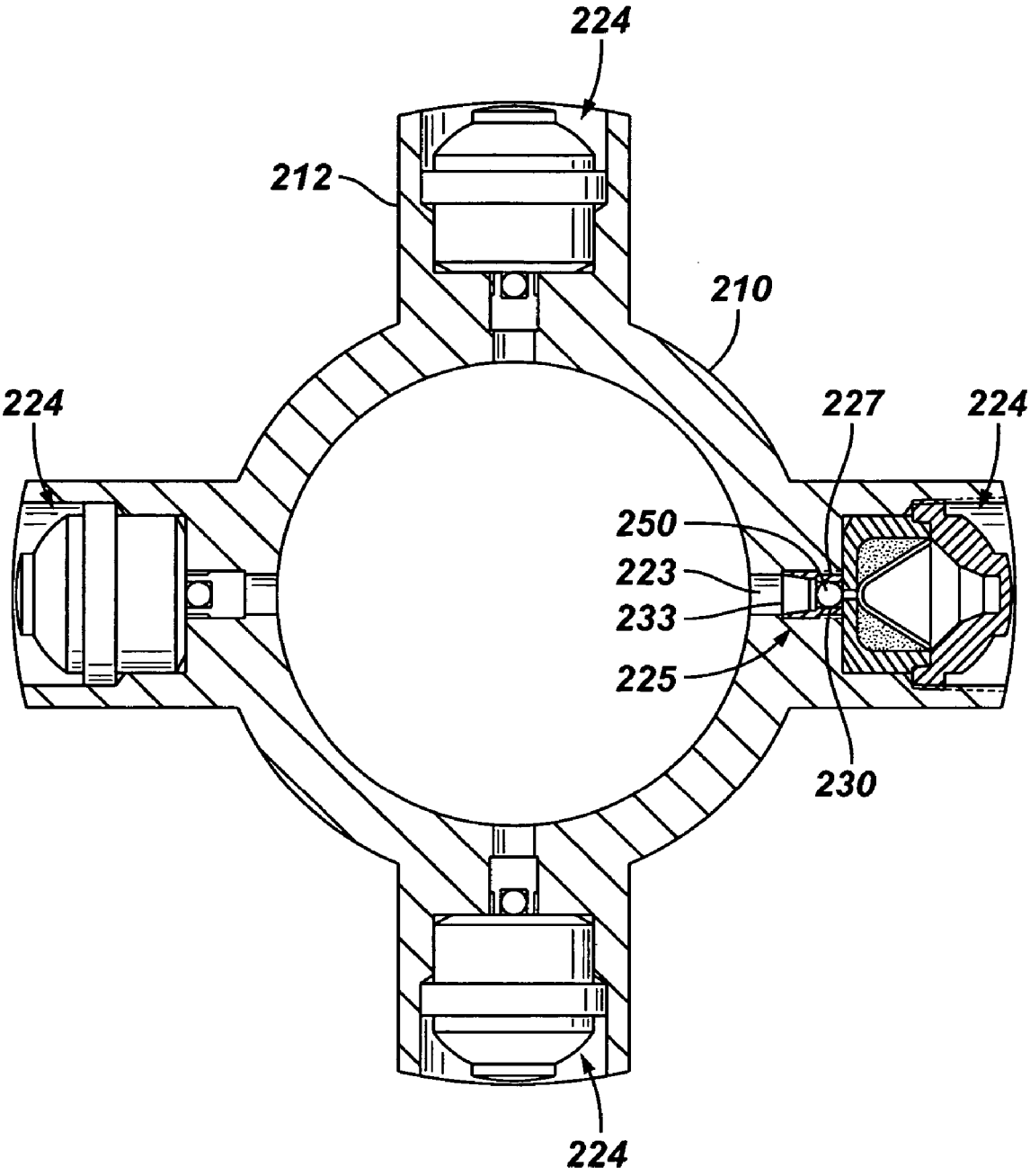
FIG. 16 depicts a cross-sectional view of the casing taking along lines 16-16 of FIG. 11 according to an embodiment of the invention.

As depicted in FIG. 16, each perforating charge 224 is radially disposed so that the perforation jet formed from the perforating charge 224 extends in a radial direction away from the longitudinal axis of the casing. For each perforating charge 224, the main casing body 210 includes an opening 223 that radially extends between the central passageway of the tool 200 and the opening 220 (in the fin 212) that receives the perforating charge 224. Before the perforating charge 224 fires, a plug 225 is received in the opening 223 so that the passageway wall that defines the opening 223 forms a friction fit with the plug 225.

Figure 13:
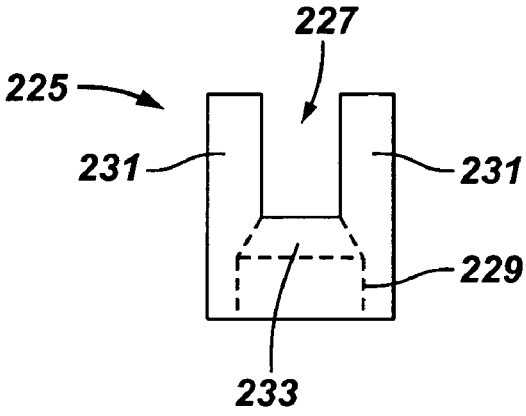
FIG. 13 is a side view of a plug according to an embodiment of the invention.
Figure 14:
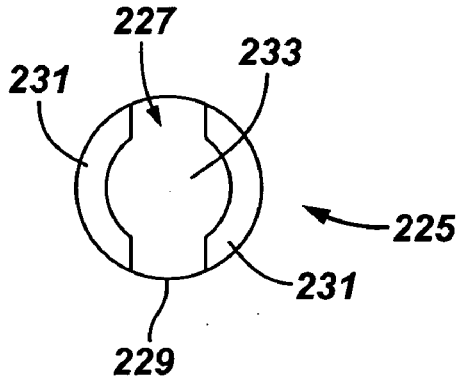
FIG. 14 is a top view of the plug according to an embodiment of the invention.

The presence of the plug 225 seals off the opening 223 so that during cementing through the central passageway of the tool 200, the cement does not enter the opening 223 and affect later operation of the perforating charge 224. Referring also to FIGS. 13 (a top view of the plug 225) and 14 (a side view of the plug 225), in some embodiments of the invention, the plug 225 includes side walls 231 that form a slot 227 to receive a detonating cord 250 that is received in the groove 230 (see also FIG. 15). The side walls 231 extend from a cylindrical base, a portion of which forms a rupture disk 233. The rupture disk 233 contacts the detonating cord 250. Therefore, when a detonation wave propagates along the detonating cord 250, the detonation wave serves the dual function of rupturing the rupture disk 233 and firing the perforating charge.

Thus, the firing of each perforating charge 224 creates a tunnel into the formation and an opening through what remains of the perforating charge 224. The rupturing of the rupture disk 233 creates an opening through the plug 225 to establish well fluid communication between the formation and central passageway of the tool 200 via the opening 233.

Therefore, after the perforating charges 224 of the tool 200 fire, the tool 200 transitions into a production casing, in that well fluid is produced through the openings 233.

Figure 17:
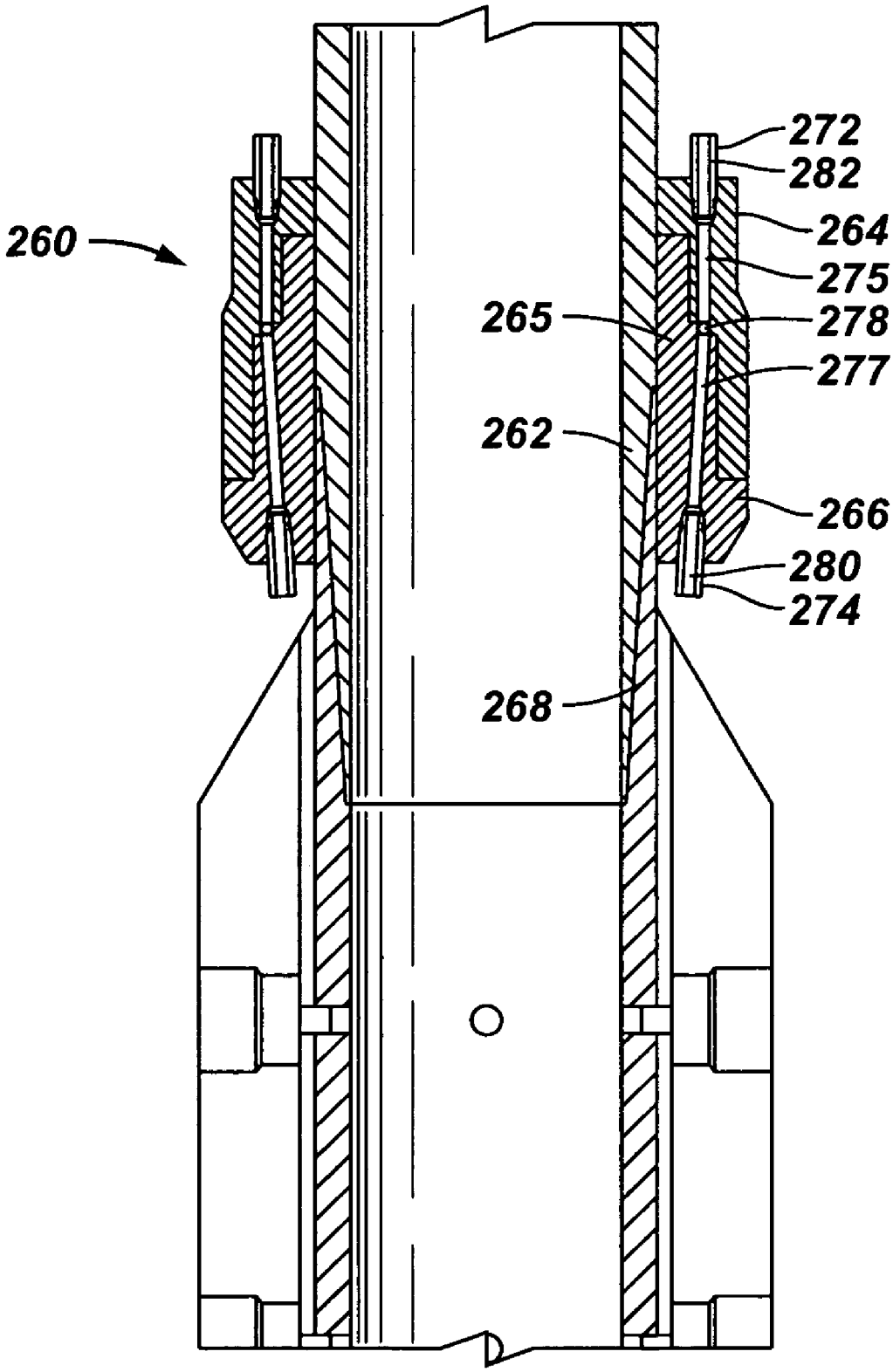
FIG. 17 depicts a ballistic junction according to an embodiment of the invention.

Referring to FIG. 17, in some embodiments of the invention, the tool 200 may be ballistically connected to an adjacent tool via a ballistic junction 260. In the embodiment depicted in FIG. 17, the junction 260 is attached to a lower end 262 of a particular tool 200 and located near an upper end 268 of an adjacent tool 200. The lower 262 and upper 268 ends may be threadably connected together for purposes of attaching the two tools 200 together.

The ballistic junction 260 includes an inner collar 265 that is attached (via threads or welds, for example) to the lower end 262 of the upper tool 200. An outer collar 266 is threaded onto the inner collar 265. The ballistic junction 260 has the following structure for each detonating cord that is longitudinally coupled through the junction 260. The structure includes an opening in inner collar 265, an opening that receives a hydraulic seal fitting nut 274. The nut 274 receives and secures a lower detonator 280 to the inner collar 265. The lower detonator 280, in turn, is connected to a detonating cord that extends from the detonator 280 into one of the fins 212 of the lower tool 200. The outer collar 266 includes an opening that receives a hydraulic seal fitting nut 272. The nut 272 receives and secures an upper detonator 282 to the outer collar 266. The upper detonator 282, in turn, is connected to a jumper detonating cord that extends from the detonator 282 into one of the fins 212 of the upper tool 200. The jumper detonating cords make the ballistic connection across the threaded casing joint, and are installed after the casing joint is made up, in some embodiments of the invention.

For each detonating cord that is longitudinally coupled through the junction 260, the ballistic junction 260 includes a detonating cord 277 that longitudinally extends from the lower detonator 274 to a detonating cord 278; and a detonating cord 275 that longitudinally extends from the upper detonator 272 to the detonating cord 278. Thus, due to this arrangement, a detonation wave propagating along either detonating cord 275 or 277 is relayed to the other cord. The detonating cord 278 extends circumferentially around the tool 200 and serves as a redundant detonating cord to ensure that an incoming detonation received on one side of the junction 160 is relayed to all detonating cords on the other side of the ballistic junction 160.

Figure 18:
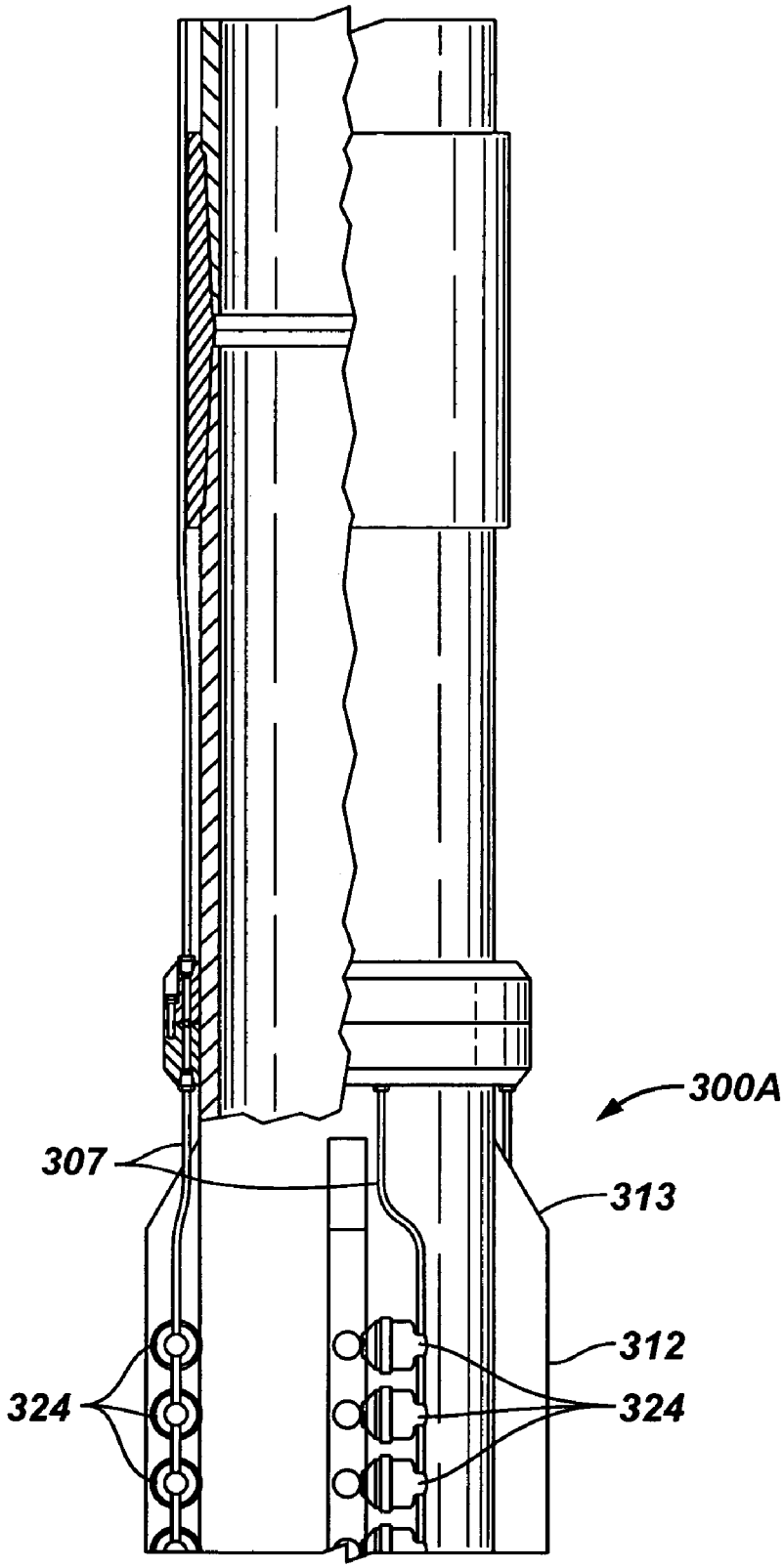
FIGS. 18 and 19 depict a casing conveyed tool according to another embodiment of the invention.
Figure 19:
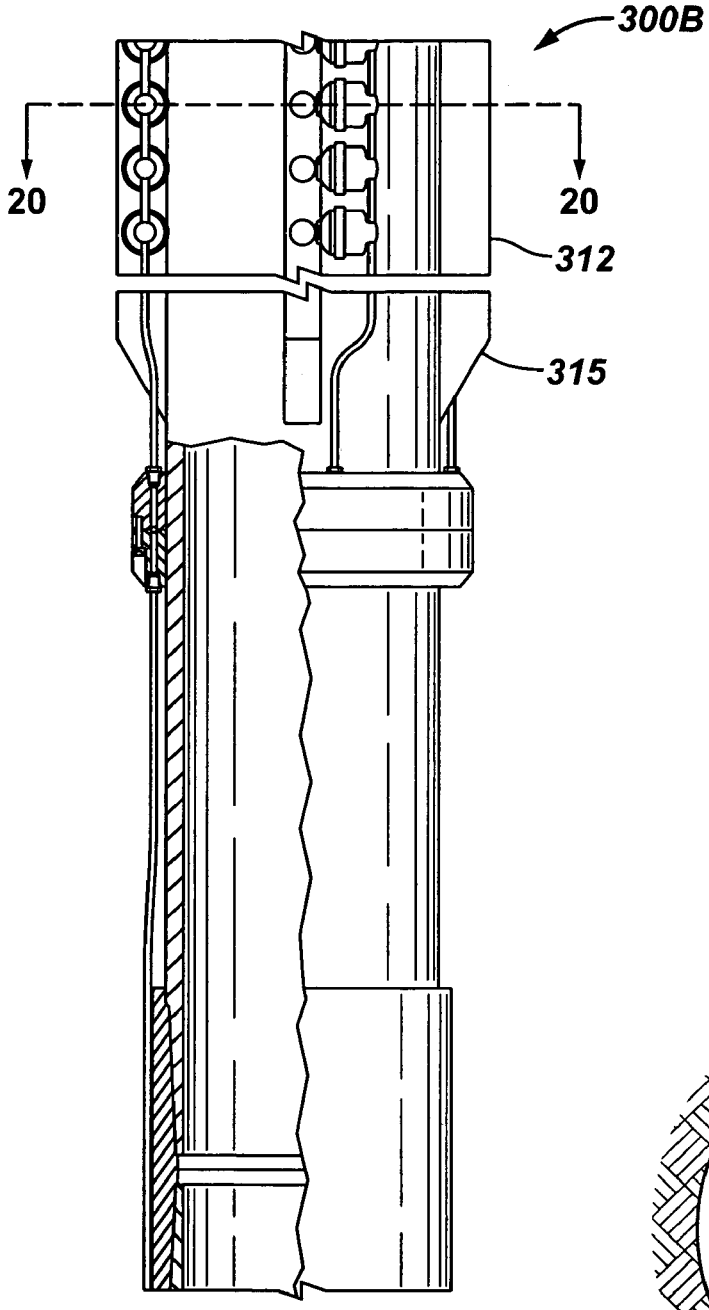

Other variations are possible for the casing conveyed perforating tool. For example, FIGS. 18 and 19 depict upper 300A and lower 300B sections of another perforating tool 300 in accordance with the invention. Unlike the casing conveyed perforating tool 200, the tool 300 includes perforating charges (shaped charges, for example,) that are oriented to fire tangentially to the longitudinal axis of the tool 300. This is in contrast to the tool 200 in which the perforating charges fire radially with respect to the longitudinal axis of the tool 200.

As depicted in FIGS. 18 and 19, each perforating charge 32 is connected to the side wall of a corresponding fin 312. Similar to the tool 200, the fins 312 serve as a stabilizer for the casing string. Furthermore, each fin 312 includes upper 313 and lower 315 beveled surfaces, similar to the tool 200.

Unlike the tool 200, the perforating charges 324 of the tool 300 are directed so that the perforation jet from the perforating charges 324 are directed through the fin 312 to which the perforating charges 312 are attached. As depicted in FIGS. 16 and 17, the tool 300 includes detonating cords 307, each of which is associated with a particular fin 312. As shown, each detonating cord 307 is routed along a corresponding fin 312 and through the associated perforating charges 324 of the fin 312.

Figure 20:
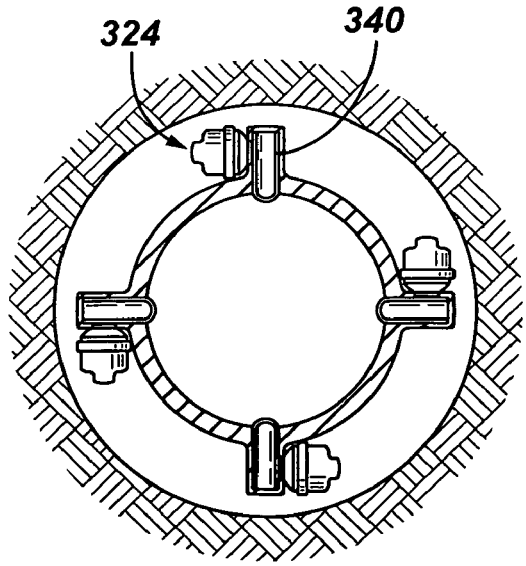
FIG. 20 is a cross-sectional view of the tool taken along line 20-20 of FIG. 19 according to an embodiment of the invention.

FIG. 20 depicts a cross-sectional view of the tool 300, taken along lines 20-20 of FIG. 19. As shown in this figure, each fin 312 contains an internal passageway so that when the perforating charges 324 fire, communication is established through the fins 312 into the central passageway of the tool 300. For purposes of sealing off the internal passageways of the fins 312 before the firing of the perforating charges 324, the tool 300, in some embodiments of the invention, includes a knockout plug 340 for each associated perforating charge 324. The knockout plug 340 protrudes into the central passageway of the tool 300 so that a tool may be run downhole to break these plugs 340 after the perforating charges 324 fire. Similar to the tool 200, the tool 300 may include other features such as a ballistic junction 308, similar to the ballistic junction 260 discussed above.

While the present invention has been described with respect to a limited number of embodiments, those skilled in the art, having the benefit of this disclosure, will appreciate numerous modifications and variations therefrom. For instance, although the present invention has been shown used in a land well, the present invention may also be used in a subsea well. It is intended that the appended claims cover all such modifications and variations as fall within the true spirit and scope of this present invention.

The invention claimed is:

1. A method usable with a subterranean well, comprising:
communicating a wireless stimulus downhole in the well;
actuating a casing conveyed perforating gun in response to the communication;
downhole in the well, confirming firing of the perforating gun; and
in response to the confirmation of the firing, communicating another wireless stimulus from a transmitter integrated with a casing string uphole to indicate the confirmation.

2. The method of claim 1, wherein the communicating the wireless stimulus downhole comprises:
transmitting an electromagnetic wave from the surface of the well through at least one formation.

3. The method of claim 1, wherein the communicating the wireless stimulus downhole comprises:
communicating a seismic wave from the surface of the well through at least one formation.

4. The method of claim 1, wherein the communicating the wireless stimulus downhole comprises:
communicating an acoustic wave downhole.

5. The method of claim 4, further comprising:
communicating the acoustic wave on at least one of a production tubing and the casing string.

6. The method of claim 1, wherein the communicating the wireless stimulus downhole comprises:
communicating a pressure pulse downhole.

7. The method of claim 6, further comprising:
communicating the pressure pulse through at least one of a fluid in a production tubing and a fluid in an annulus.

8. The method of claim 1, further comprising:
encoding the stimulus to indicate a command; and
decoding the stimulus near the perforating gun to extract the command.

9. A system usable with a subterranean well, comprising:
a casing string comprising a casing conveyed perforating gun located downhole in the well; and
an apparatus to communicate a wireless stimulus downhole to the perforating gun to actuate the perforating gun;
a circuit located downhole to confirm firing of the perforating gun; and
a transmitter integrated with the casing string to in response to the confirmation of the firing of the perforating gun, communicate another wireless stimulus uphole indicative of the firing.

10. The system of claim 9, further comprising:
a firing system to fire the perforating gun in response to the wireless stimulus.

11. The system of claim 9, wherein the apparatus is adapted to transmit an electromagnetic wave from the surface to the tool through at least one formation.

12. The system of claim 9, wherein the apparatus is adapted to communicate a seismic wave from the surface through at least one formation.

13. The system of claim 9, wherein the apparatus is adapted to communicate an acoustic wave downhole to actuate the perforating gun.

14. The system of claim 13, wherein said apparatus is further adapted to communicate the acoustic wave using at least one of a production tubing and a casing string.

15. The system of claim 9, where the apparatus is adapted to communicate a pressure pulse downhole to actuate the perforating gun.

16. The system of claim 15, wherein the apparatus is further adapted to communicate the pressure pulse through at least one of a fluid in a production tubing and a fluid in an annulus.

17. The system of claim 9, wherein the apparatus is further adapted to:
encode the stimulus to indicate a command, and
decode the stimulus near the perforating gun to extract the command.

18. A perforating gun comprising:
perforating charges adapted to be embedded in a casing string section to perform a downhole function,
a mechanism adapted to respond to a wireless stimulus transmitted from a surface of the well to fire the perforating charges;
a circuit located downhole near the perforating gun to confirm firing of the perforating charges; and
a transmitter embedded in the casing string section to in response to the confirmation communicate another wireless stimulus uphole to confirm firing of the perforating charges.

19. The tool of claim 18, wherein the stimulus comprises at least one of the following:
an acoustic wave, an electromagnetic wave, a seismic wave and a fluid pressure pulse.

20. The tool of claim 18, wherein the mechanism is integrated into the casing string section.

* * * * *